US005172442A

United States Patent [19]

Bartley et al.

[11] Patent Number: 5,172,442

[45] Date of Patent: Dec. 22, 1992

[54] LITTER SUPPORT HAVING TELESCOPING THREADED ROD ARRANGEMENT

[75] Inventors: Gary L. Bartley, Kalamazoo Township, Kalamazoo County; Louis A. Haddock, Jr., Emmett Township, Calhoun County; John S. Messner, Battle Creek, all of Mich.

[73] Assignee: Stryker Corporation, Kalamazoo, Mich.

[21] Appl. No.: 816,826

[22] Filed: Jan. 3, 1992

[51] Int. Cl.[5] ..... A61G 7/00

[52] U.S. Cl. ..... 5/611; 5/11; 5/86.1; 254/102; 254/92

[58] Field of Search ..... 5/11, 611, 86.1; 254/7 R, 7 C, 92, 102, DIG. 2

[56] References Cited

U.S. PATENT DOCUMENTS

| | | | |
|---|---|---|---|
| 1,565,878 | 12/1925 | White | 254/102 |
| 1,874,357 | 8/1932 | Runyan | 254/102 |
| 1,874,772 | 8/1932 | Lucker | 254/102 |
| 1,906,365 | 5/1933 | Burkholder | 254/102 |
| 2,127,309 | 8/1938 | Rickard | 5/86.1 |
| 2,522,759 | 9/1950 | Lindquist | 5/611 X |
| 3,253,284 | 5/1966 | St. John | 5/611 |
| 4,609,179 | 9/1986 | Chern et al. | 254/102 |

*Primary Examiner*—Michael F. Trettel

*Attorney, Agent, or Firm*—Flynn, Thiel, Boutell & Tanis

[57] ABSTRACT

A hospital bed includes a base supported by casters, and a lift arrangement vertically movably supports a patient support section on the base. The lift arrangement includes a threaded first member secured to and projecting downwardly from the patient support section, a rotatably supported tubular second member having an internal thread which engages the threaded first member and having an external thread, and a further member which is supported on the base and has a thread engaging the external thread on the tubular second member. In one embodiment, the further member is a nut fixedly supported on the base, and a drive member rotatably supported on the base has an opening through which the second member extends and has a key portion which slidably engages an axially extending slot provided in the second member. In a different embodiment, the further member is itself rotatably supported on the base and has therethrough an opening through which the second member extends, the thread on the further member being an internal thread in the opening.

17 Claims, 3 Drawing Sheets

LITTER SUPPORT HAVING TELESCOPING THREADED ROD ARRANGEMENT

FIELD OF THE INVENTION

The present invention relates to a mechanism for moving a movable part of a hospital bed and, more particularly, to such a mechanism which moves a patient support portion of the bed vertically with respect to a base and which has a threaded member rotatably driven by a motor and operatively engaging a nut.

BACKGROUND OF THE INVENTION

Over the years, various arrangements have been developed to effect movement of different parts of a mobile hospital bed with respect to each other. For example, upward and downward movement of a patient support litter relative to a base has been effected with a pair of spaced hydraulic cylinders which have the cylinder housings fixedly mounted on the base and which have vertically extending piston rods with their upper ends fixedly secured to the patient support portion. However, hydraulic arrangements tend to drip oil, which creates a mess and which in some cases presents a safety problem when the oil ends up on a floor surface where someone may slip on it. In order to be competitive in today's marketplace, a hydraulic arrangement must usually include both electrically and manually actuated pumps, which tends to render the overall hydraulic system rather complex and expensive. Further, if the cylinders each have only a single piston, then in order for the lowest position of the patient support litter to be reasonably low, the lower end of the hydraulic cylinder must be mounted relatively close to the floor, which increases the chance it may fail to clear an obstruction when the mobile bed is being moved, resulting in possible damage to the hydraulic cylinder and/or a need to manually lift the bed over the obstruction.

As a known alternative to hydraulic cylinders, the patient support litter is sometimes supported on the base by a scissors mechanism, which may be driven by a electric drive mechanism or by a single small hydraulic cylinder. In either case, the scissors mechanism has a number of potential points at which a finger or other body part could be caught and pinched, which can present a safety problem. Also, scissors mechanisms tend to be relatively complex and therefore expensive. Further, the vertical space required by a scissors mechanism between a patient support litter and a base tends to be sufficiently large that it is difficult to achieve a design in which the patient support litter can move to a relatively low position.

Beds often have other movable parts, such as a movable knee support section of a patient support assembly. Arrangements of this type are usually driven by an electric motor, and the most common approach is to fixedly support on the bed frame an electric motor having an elongate rotatable shaft which is threaded, to support a nut on the shaft for movement therealong relative to the frame, and to use a link mechanism to operationally couple the nut to the part to be moved.

An object of the present invention is to provide an electrically driven arrangement for effecting relative movement of two parts of a hospital bed which is relatively simple in structure and which is cheaper than known arrangements, and in particular which is suitable for effecting vertical movement of a patient support litter relative to a base.

A further object is to provide such an arrangement which has no serious pinch points and is thus safer than known scissors mechanisms.

A further object is to provide such an arrangement which, when used to movably support a patient support litter on a base, has a minimal vertical height in its collapsed position so that the patient support litter can be moved to a relatively low position with respect to the base, and which has a relatively large range of movement in comparison to known devices.

A further object is to provide such an arrangement which is durable and reliable.

SUMMARY OF THE INVENTION

The objects and purposes of the invention, including those set forth above, are met according to one form of the invention by providing a bed which includes first and second parts, one of the first and second parts being a base portion and the other thereof being a support portion for supporting a person, and a selectively actuable first arrangement for effecting relative vertical movement of the first and second parts, the first arrangement including an elongate, vertically extending threaded member which is fixedly connected at one end to the first part, a nut rotatably supported on the second part and threadedly engaging the threaded member, and a second arrangement for selectively effecting rotation of the nut relative to the second part.

A different form of the present invention involves the provision of an apparatus which includes first and second parts supported for relative movement and an arrangement for effecting relative movement of the first and second parts, such arrangement including an elongate member supported on the first part, an elongate tube having the elongate member extending thereinto, the elongate member and elongate tube being rotatable relative to each other about a common axis, the elongate tube being rotatable relative to a further member which is supported on the second part so as to be held against axial movement with respect to the second part, an arrangement responsive to relative rotation of the tube and the elongate member for effecting relative lengthwise movement thereof, an arrangement responsive to relative rotation of the tube and further member for effecting lengthwise movement of the tube relative to the further member, an arrangement for effecting rotation of the tube relative to the elongate member, and means for effecting rotation of the tube relative to the further member.

BRIEF DESCRIPTION OF THE DRAWINGS

Two preferred embodiments of the invention are described in detail hereinafter with reference to the accompanying drawings, in which.

DETAILED DESCRIPTION

Figure 1:
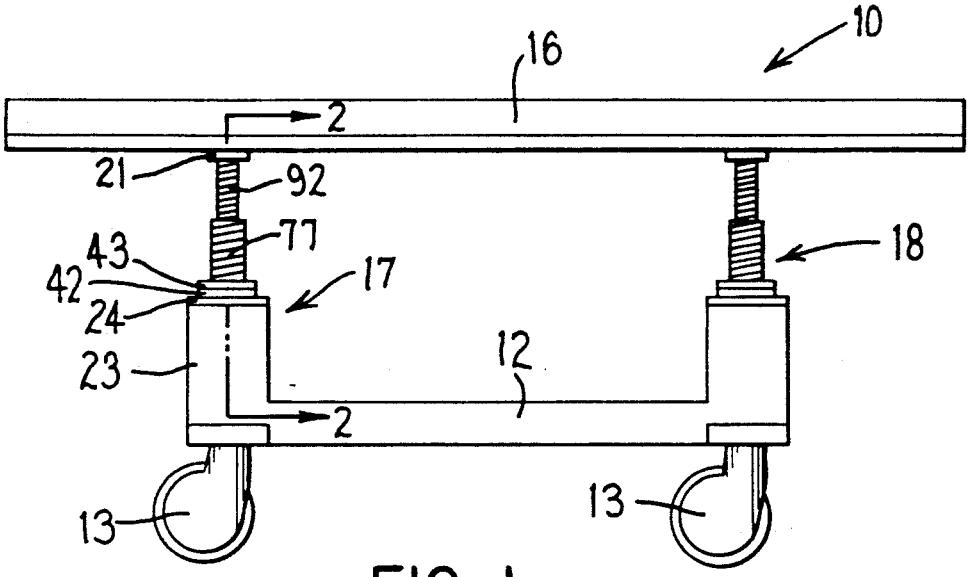
FIG. 1 is an elevational side view of a mobile hospital bed embodying the present invention.

FIG. 1 is a side view of a mobile hospital bed or stretcher 10. The bed 10 has a base 12 movably supported in a conventional manner on several casters 13, and has a conventional patient support litter 16 vertically movably supported on the base 12 by two spaced pedestals 17 and 18. The pedestal 18 includes two laterally spaced screw lift mechanisms, one of which is visible in FIG. 1, and the pedestal 17 includes a single screw lift mechanism which is shown in detail in FIG. 2 and is described in detail below. All of the screw lift mechanisms in the pedestals 17 and 18 are substantially identical, and therefore only the screw lift mechanism in the pedestal of FIG. 17 is described in detail.

Figure 2:
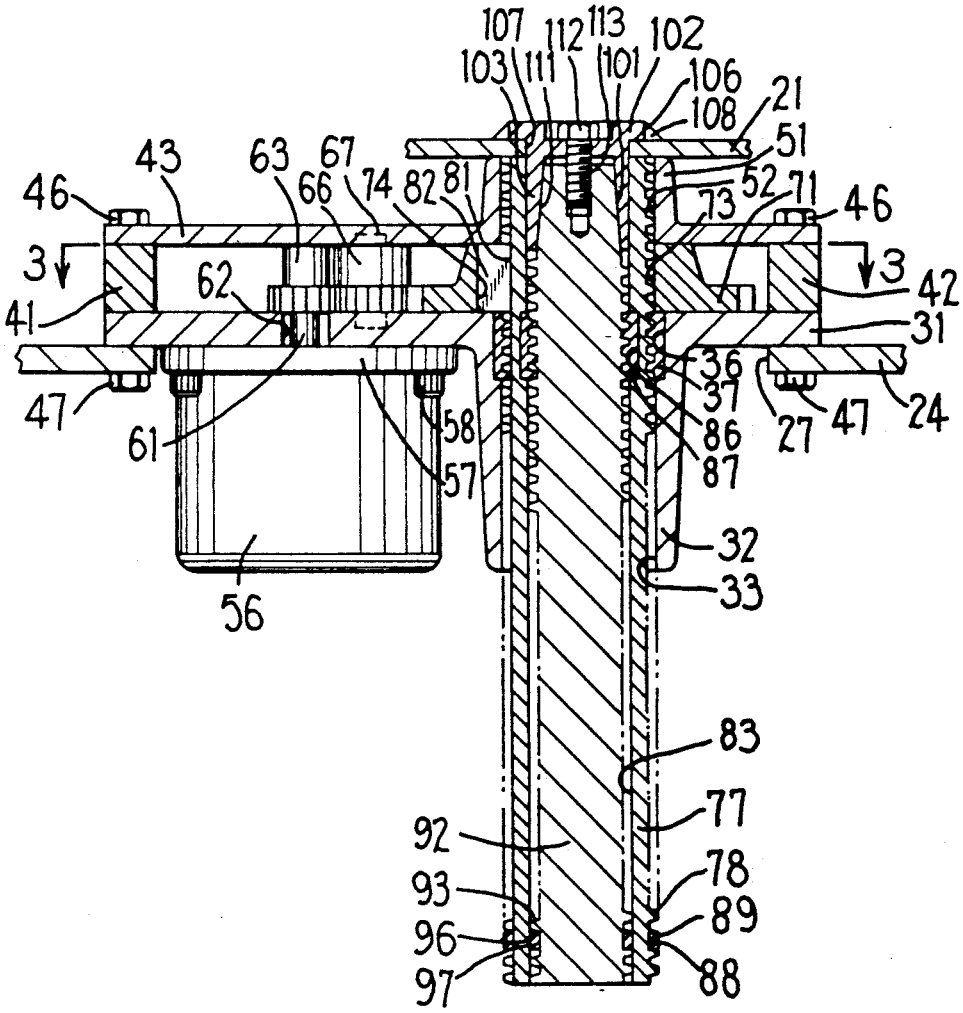
FIG. 2 is a sectional view taken along the line 2—2 of FIG. 1, but showing a different operational position of certain illustrated components.

Referring to FIGS. 1 and 2, the patient support litter 16 has secured to the underside thereof a laterally extending horizontal plate 21. The base 12 has two laterally spaced upward projections 23, one of which is visible in FIG. 1, and a rectangular metal support plate 24 extends between and is secured to the upper ends of the portions 23. The plate 24 has in it a rectangular opening 27, and a rectangular metal bottom plate 31 is provided on the plate 24 with its peripheral edge portions supported on top of the plate 24 and its central portion extending across the opening 27 so as to cover the opening 27. As shown in FIG. 2, a cylindrical metal guide portion 32 projects downwardly from the underside of the plate 31, and a cylindrical opening 33 extends concentrically and vertically through the cylindrical guide portion 32 and plate 31. At the upper end of the opening 33 is an annular recess 36 having a diameter greater than that of the opening 33, and an annular nut 37 having a helical internal thread is disposed in the annular recess 36. The thread on nut 37 projects radially inwardly into the opening 33 from a cylindrical surface on the nut which has a diameter at least as large as the diameter of opening 33.

Figure 3:
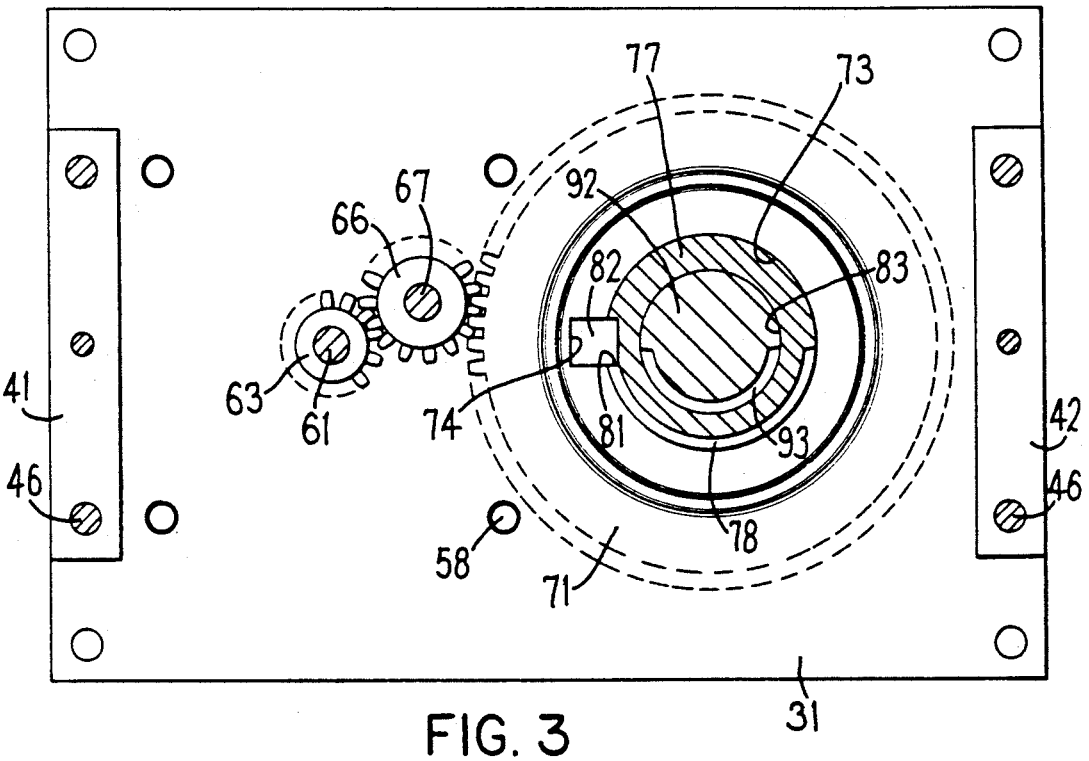
FIG. 3 is a sectional view taken along the line 3—3 in FIG. 2.

As shown in FIGS. 2 and 3, metal spacer blocks 41 and 42 are provided on top of the plate 31 at opposite ends thereof, and a metal top plate 43 extends between and has its ends supported on top of the spacer blocks 41 and 42. Several bolts 46 each extend through aligned openings in the top plate 43, spacer block 41 or 42, bottom plate 31 and support plate 24, and each threadedly engage a nut 47 so as to fixedly secure the plates and spacer block together.

The top plate 43 has a cylindrical metal guide portion 51 projecting upwardly from the upper side thereof, and concentrically and vertically extending through the guide portion 51 is a cylindrical opening 52 which is equal in diameter to and is coaxially aligned with the cylindrical opening 33 through the guide portion 32.

As shown in FIG. 2, an electric motor 56 has a flange 57 which is disposed against the underside of the plate 31 near the guide portion 32, the flange 57 being fixedly secured to the plate 31 by four bolts 58 which extend through holes in the flange and engage threaded holes in the plate 31. The motor 56 is a conventional and commercially available reversible motor. The motor 56 has an upwardly projecting rotatable shaft 61 which extends concentrically through a vertical opening 62 in the plate 31, the opening 62 having a diameter larger than that of the shaft 61. A pinion 63 is fixedly secured to the upper end of the shaft 61, the axial length of the pinion being slightly less than the distance between the plates 31 and 43 so that the pinion 63 can rotate between the plates with no significant frictional engagement therewith.

An idler gear 66 disposed between the plates 31 and 43 also has an axial length slightly less than the distance between the plates, the idler gear 66 being rotatably supported on a vertically extending cylindrical pin 67 having its ends disposed in blind holes in the plates 31 and 43. The idler gear 66 has teeth which meshingly engage teeth on the pinion 63.

Also disposed between the plates 31 and 43 is a drive gear 71 which has a substantially larger diameter than either the pinion 63 or idler 66, the drive gear 71 having an axial length which is slightly less than the distance between the plates 31 and 43 so that it can rotate therebetween with minimal friction. The drive gear 71 has teeth on its periphery which meshingly engage the teeth on the idler gear 66. The drive gear 71 also has a cylindrical central opening 73 extending vertically therethrough, the opening 73 being equal in diameter to and being coaxially aligned with the openings 33 and 52 in the guide portions 32 and 51. The drive gear 71 also has in one side of the central opening 73 a rectangular axial groove 74 which serves as a keyway.

An elongate, cylindrical, tubular outer screw member 77 is made of metal and has a helical thread 78 extending along its outer surface. The outside diameter of the screw member 77, including the thread, is slightly less than the diameters of the openings 33 and 52 in the guide portions 32 and 51, so that the screw member 77 can move axially within the openings without significant friction and with negligible radial play. The outer screw member 77 extends through the openings 33 and 52, and the thread 78 thereon engages the thread of the nut 37. The screw member 77 has in an external surface thereof an axially-extending slot 81 (FIG. 3) of rectangular cross section. A rectangular metal key 82 is provided between the plates 31 and 43 in engagement with the keyway 74 in drive gear 71 and the slot 81 in outer screw member 77. The key 82 is held against axial movement by the plates 31 and 43, but is axially slidable within the slot 81 in the outer screw member 77. Although the key 82 is a separate structural part in the preferred embodiment, it will be recognized that it could alternatively be an integral part of the drive gear 71.

A central opening 83 through the outer screw member 77 is cylindrical, and an annular rectangular groove 86 is provided in the surface of the opening 83 at a location spaced from the upper end of outer screw member 77 by a distance which is approximately a quarter of the axial length of the member 77. A sleeve-like nut 87 is disposed within the groove 86, a helical internal thread on the nut 87 projecting radially inwardly into the opening 83 from an inner surface of the nut which has a diameter equal to or slightly greater than the diameter of the opening 83.

The outer screw member 77 also has an annular groove 88 provided in the exterior surface thereof at a location spaced a short distance above the lower end of member 77. An annular ring 89 is disposed in the groove 88, the outer diameter of the ring 89 preferably being slightly greater than the outer diameter of the thread 78 on member 77, so that the ring 89 rather than the thread slidably engages the inner surface of opening 33. In the preferred embodiment, the ring is made of polytetrafluoroethylene (which is commonly referred to with the trademark Teflon), but there are other materials which would also be suitable.

An elongate, cylindrical, inner metal screw member 92 has a helical thread 93 extending along an exterior surface thereof, the outside diameter of the screw member 92, including thread 93, being slightly less than the diameter of the central opening 83 through the outer screw member 77, so that the screw member 92 can move axially within the opening 83 without significant friction and with negligible radial play. The inner screw member 92 extends within the central opening 83 in the outer screw member 77, the helical thread 93 engaging the thread on nut 87. An annular groove 96 is provided in the exterior surface of the inner screw member 92 a short distance above the lower end thereof, and an annular ring 97 is disposed within the groove 96, the ring 97 preferably being made of the same material as the ring 89. The outside diameter of the ring 97 preferably is slightly larger than the outside diameter of the thread 93 on the screw member 92.

At the upper end of the screw member 92 is an upwardly tapering frustoconical surface 101. A metal fitting 102 has a cylindrical stem 103 with a diameter substantially equal to the outside diameter of the thread 93 on the inner screw member 92, and has at the upper end of the cylindrical stem 103 a radially outwardly projecting annular flange 106. The stem 103 extends through a circular opening 107 provided in the plate 21 of the frame 16 (FIG. 1), the diameter of the hole 107 being approximately equal to the diameter of the stem 103. The flange 106 is disposed against the upper surface of the plate 21, and is fixedly secured thereto by a welding bead 108. Extending into the fitting 102 from a lower end of the stem 103 is an upwardly tapering frustoconical hole 111 which receives the frustoconical upper end of the inner screw member 92. A screw 112 has a shank extending downwardly through a central opening in the fitting 102 and threadedly engaging a vertical threaded hole 113 provided in the upper end of the inner screw member 92. Thus, the screw 112 and fitting 102 rigidly secure the inner screw member 92 to the plate 21 and prevent relative rotation therebetween.

Figure 5:
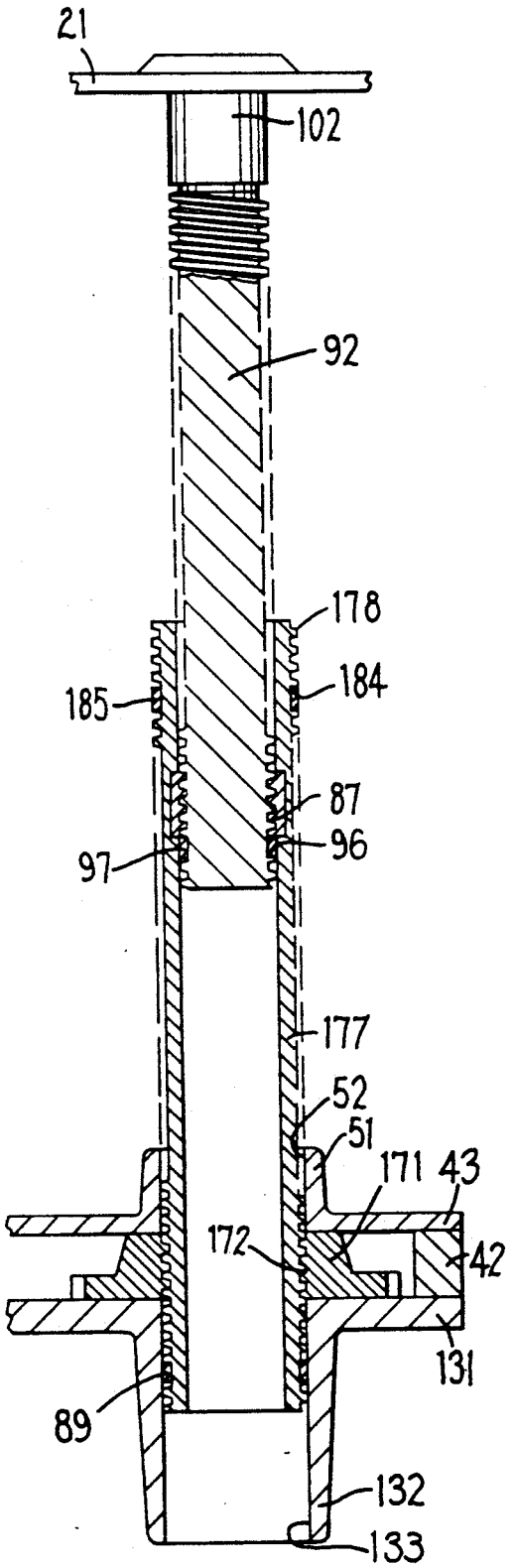
FIG. 5 is a sectional view similar to FIG. 4 but showing a variation of the embodiment of FIG. 4.

An alternative embodiment of the inventive apparatus is shown in FIG. 5. In most respects, the embodiment of FIG. 5 is identical to the embodiment just described, and thus only the differences are described in detail. Components in FIG. 5 which correspond directly to components in FIGS. 1–4 are identified with the same reference numerals.

Figure 4:
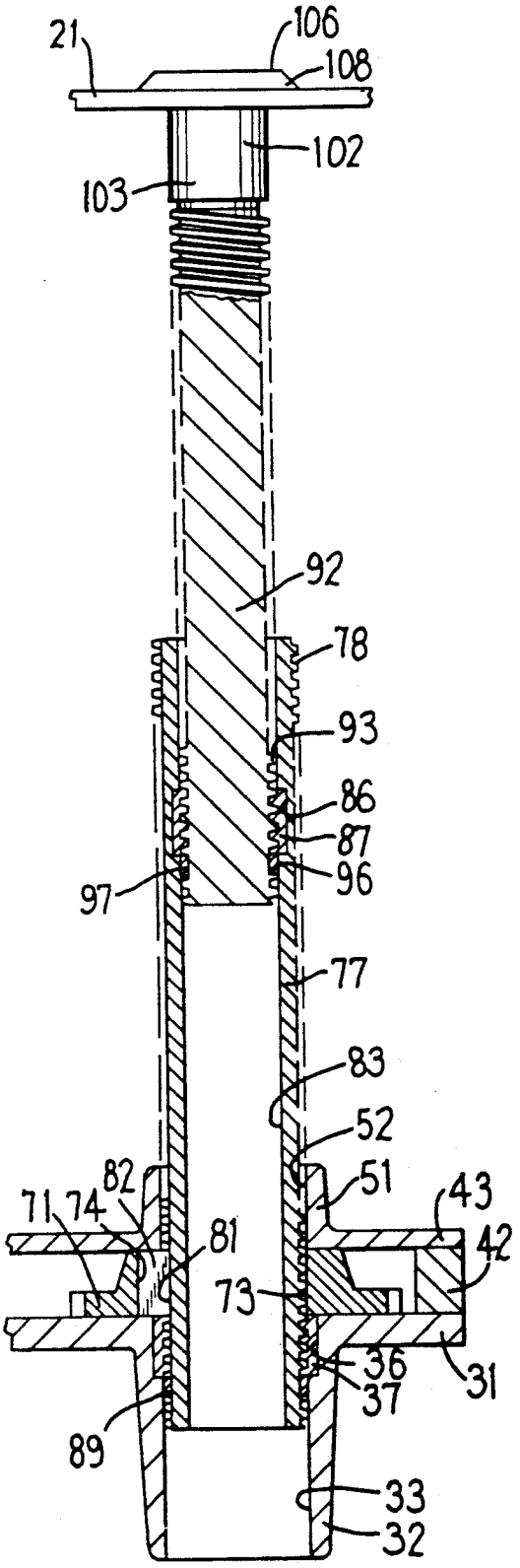
FIG. 4 is a sectional view of a portion of the structure shown in FIG. 2 but in a different operational position.

The embodiment of FIG. 5 lacks a nut equivalent to that shown at 37 in FIG. 4, and lacks a key equivalent to that shown at 82 in FIG. 4. Instead, the drive gear 171 in FIG. 5 has therethrough a central opening 172 which is threaded and which directly cooperates with the helical thread 178 on the outer screw member 177. In addition, the outer screw member 177 has an annular groove provided in the exterior surface thereof a short distance below its upper end, and disposed in the annular groove 184 is an annular ring 185. The annular ring 185 is preferably made of the same material as the annular rings 89 and 97. The outer diameter of the annular ring 185 preferably is slightly greater than the outer diameter of the thread 178 on outer screw member 177.

OPERATION

Assume that, with the various illustrated components in the operational positions of FIG. 2, the motor 56 is energized in a manner effecting rotation of the shaft 61 is a forward rotational direction. The pinion 63 rotates with the shaft 61 and rotates the idler gear 66, which in turn rotates the drive gear 71. The key 82 causes the outer screw member 77 to rotate synchronously with the drive gear 71, and the rotation of the outer screw member 77 relative to nut 37 causes the outer screw member 77 to move upwardly relative to the nut 37, gear 71 and plates 31 and 43. As the outer screw member 77 moves upwardly, the key 82 slides within the lengthwise slot 81 in the outer screw member 77.

Meanwhile, since the inner screw member 92 is fixedly held against rotation relative to the plate 21 by the screw 112 and fitting 102, the outer screw member 77 and the nut 87 thereon necessarily rotate relative to the stationary inner screw member 92. The relative rotation between nut 87 and inner screw member 92 causes the inner screw member 92 to move upwardly relative to the rotating outer screw member 77. In short, while the outer screw member 77 is moving upwardly relative to the gear 71 and plates 43 and 31, the inner screw member 92 is simultaneously moving upwardly relative to the outer screw member 77. Thus, the litter 16 (FIG. 1) is moved upwardly relative to the base 12 of the bed 10. If at some point the motor 56 is stopped, rotational movement of the outer screw member 77 and vertical movement of the inner and outer screw members 77 and 92 will halt, thereby maintaining the spacing between the litter 16 and base 12 which was present at the point in time when the motor stopped. Alternatively, if the motor continues to run, then as shown in FIG. 4 the ring 89 on the outer screw member 77 will eventually reach the nut 37 and the ring 97 on inner screw member 92 will eventually reach the nut 87. Since the rings 89 and 97 have diameters large enough to physically prevent them from moving into the nuts, rotation of the outer screw member 77 is forcibly halted in the position shown in FIG. 4 in order to prevent the telescoping lift mechanism from becoming overextended. It will be noted that, in this position, approximately $\frac{1}{4}$ to $\frac{1}{3}$ of the inner screw member 92 is still disposed within the upper end of the outer screw member 77, and approximately $\frac{1}{4}$ to $\frac{1}{3}$ of the outer screw member 77 is disposed within the guide arrangement defined by the guide portions 32 and 51. Thus, even in the extended position of FIG. 4, there is little or no radial play between the inner screw member 92 and the outer screw member 77, and likewise there is little or no radial play between the outer screw member 77 and the guide portions 32 and 51. Consequently, the litter 16 is steadily supported on the base 12 with no significant play or wobble.

In order to lower the litter 16 relative to the base 12, the motor 56 is simply energized so that the shaft 61 rotates in a reverse direction, and the illustrated structure telescopically contracts in a manner opposite but analogous to the above-described telescopic extension thereof. The motor 56 can be stopped at any point. If it continues to run, the plate 21 will eventually engage the upper end of the guide portion 51 as shown in FIG. 2 in order to forcibly halt movement of the screw members 77 and 92.

It will be recognized that the groove 88 and ring 89 could be omitted in the embodiment of FIGS. 1–4. Since the screw members 92 and 77 move synchronously, engagement of the ring 97 with the nut 87 will halt rotation of screw member 77 and thus halt axial movement of both of the screw members 92 and 77. It would also be possible to omit the ring 97 and groove 96, in which case the inner screw member 92 would stop moving upwardly when its lower end reached the top of nut 87, there being enough remaining axial overlap of the members 92 and 77 to keep the member 92 properly vertically supported by member 77. Likewise, the outer screw member 77 would stop moving upwardly when its lower end reached the top of nut 37, and then the guide portion 51 would continue to maintain the member 77 in a proper vertical orientation.

Turning to the alternative embodiment of FIG. 5, the operation is slightly different from that just described for the embodiment of FIGS. 1–4. In particular, when the drive gear 171 is rotated in a direction which will extend the telescoping screw members, the inner screw member 92 and outer screw member 177 tend to move sequentially rather than simultaneously. Depending on frictional characteristics in the engagement of the various threaded portions within the system, the outer screw member 177 may initially rotate with the drive gear 171, during which rotation the outer screw member 177 does not move upwardly relative to the drive gear 171. However, this rotation of the outer screw member 177 causes the nut 87 thereon to rotate relative to the stationary inner screw member 92, so that the inner screw member 92 moves upwardly relative to the outer screw member 177. Eventually, the annular ring 97 on the inner screw member 92 will engage the nut 87 and prevent further rotation of the outer screw member 177 relative to the inner screw member 92. Thereafter, since the outer screw member 177 does not rotate, the drive gear 171 rotates relative to the outer screw member 177, which causes the outer screw member 177 to move upwardly. If the motor continues to run, the annular ring 89 will eventually engage the drive gear 171 in order to forcibly halt upward movement of the outer screw member 177.

Alternatively, if the frictional characteristics are such that the drive gear 171 initially does rotate relative to the outer screw member 177, the outer screw member 177 will move upwardly relative to the drive gear 171 without rotating. Eventually, the annular ring 89 will engage the drive gear 171 and thereby force the outer screw member 177 to stop moving upwardly and to begin rotating with the drive gear 171. This rotation of the outer screw member 177 causes the nut 87 thereon to rotate around the stationary inner screw member 92, and thus the inner screw member 92 will move upwardly relative to the outer screw member 177. Eventually, the annular ring 97 will engage the nut 87 and thus forcibly halt movement of the illustrated components.

In order to telescopically collapse the structure illustrated in FIG. 5, the motor is operated in an opposite direction and the components will return to their original positions in a manner opposite but analogous to that described above for telescopic extension thereof. Again, depending on frictional characteristics, the outer screw member 177 may initially move downwardly relative to the rotating drive gear 171 until the annular ring 185 engages the drive gear 171, after which the inner screw member 92 will move downwardly relative to the outer screw member 177 until the plate 21 engages the upper end of the outer screw member 177. Under different frictional characteristics, the outer screw member 177 may initially rotate with the rotating drive gear 177 so that it does not move downwardly but instead the inner screw member 92 moves downwardly relative to the outer screw member 177 until the plate 21 engages the upper end of outer screw member 177, after which the outer screw member 177 will be held against rotation and thus will move downwardly relative to the rotating drive gear 171 until the annular ring 185 engages the drive gear 171 and halts movement of the illustrated components.

Two preferred embodiments of the present invention have been disclosed in detail for illustrative purposes, but it will be recognized that there are variations and modifications of the disclosed mechanisms, including the rearrangement or reversal of parts, which lie within the scope of the present invention.

The embodiments of the invention in which an exclusive property or privilege is claimed are defined as follows:

1. A bed, comprising: first and second parts, one of said first and second parts being a base portion and the other thereof being a support portion for supporting a person, and selectively actuable first means for effecting relative vertical movement of said first and second parts, said first means including an elongate, vertically extending threaded member which is supported at one end on said first part, a nut supported on said second part and threadedly engaging said threaded member, and second means for selectively effecting relative rotation of said nut and said second part; wherein said threaded member is fixedly supported on said first part, wherein said first means includes an elongate tubular member which is supported on said second part for rotation about a longitudinal axis thereof, and which has an internally threaded portion engaging said threaded member and serving as said nut, rotation of said tubular member effecting said relative vertical movement of said first and second parts; wherein said tubular member has an external thread thereon, and said first means includes a further member supported on said second part and held against vertical movement with respect to said second part, said further member having thereon a thread which threadedly engages said external thread on said tubular member, rotation of said tubular member relative to said further member effecting vertical movement of said tubular member relative to said second part and vertical movement of said threaded member relative to said tubular member; wherein said further member is a nut fixedly coupled to said second part; wherein said tubular member has a longitudinally extending slot in an exterior surface thereof; wherein said second means includes a drive member rotatably supported on said second part and having thereon a key portion axially slidably disposed in said slot in said tubular member; wherein said drive member is a gear; and wherein said second means includes an idler gear rotatably supported on said second part and drivingly engaging said drive gear, and includes a reversible drive motor supported on said second part and having on a drive shaft thereof a pinion which drivingly engages said idler gear.

2. A bed of claim 1, wherein said second part includes vertically spaced and horizontally extending first and second plates, said pinion, said idler gear and said drive gear each being disposed between said first and second plates and having an axial length slightly less than the vertical distance between said plates.

3. A bed of claim 2, including two tubular guide portions each fixedly provided on a respective one of said plates on a side thereof opposite from the other of said plates, said guide portions each having therethrough a central opening with a diameter slightly greater than an outside diameter of said external thread on said tubular member, said central openings in said guide portions being in coaxial alignment with each other and with an axis of rotation of said drive member.

4. A bed of claim 1, wherein said further member is a drive member which is rotatably supported on said second part, and including means for limiting upward and downward movement of said tubular member relative to said drive member and means for limiting upward and downward movement of said threaded member relative to said tube.

5. A bed comprising: first and second parts, one of said first and second parts being a base portion and the other thereof being a support portion for supporting a person, and selectively actuable first means for effecting relative vertical movement of said first and second parts, said first means including an elongate, vertically extending threaded member which is supported at one end on said first part, a nut supported on said second part and threadedly engaging said threaded member, and second means for selectively effecting relative rotation of said nut and said second part; wherein said threaded member is fixedly supported on said first part, wherein said first means includes an elongate tubular member which is supported on said second part for rotation about a longitudinal axis thereof, and which has an internally threaded portion engaging said threaded member and serving as said nut, rotation of said tubular member effecting said relative vertical movement of said first and second parts; wherein said tubular member has an external thread thereon, and said first means includes a further member supported on said second part and held against vertical movement with respect to said second part, said further member having thereon a thread which threadedly engages said external thread on said tubular member, rotation of said tubular member relative to said further member effecting vertical movement of said tubular member relative to said second part and vertical movement of said threaded member relative to said tubular member; wherein said further member is a drive member which is rotatably supported on said second part; including means for limiting upward and downward movement of said tubular member relative to said drive member and means for limiting upward and downward movement of said threaded member relative to said tube; wherein said means for limiting movement of said tubular member includes said tubular member having axially spaced circumferential grooves therein and includes in each said circumferential groove a stop ring having an outside diameter substantially equal to an outside diameter of said external thread on said tubular member; and wherein said means for limiting movement of said threaded member relative to said tubular member includes said threaded member having therein a circumferential groove and having in said circumferential groove a stop ring with an outside diameter substantially equal to the outside diameter of the thread on said threaded member.

6. A bed of claim 5, wherein said second part includes first and second tubular guide portions fixedly supported on said second part on opposite sides of said drive member, said guide portions each having therethrough an opening with a diameter slightly greater than an outside diameter of said external thread on said tubular member, said openings in said guide portions being coaxial and said tubular member extending coaxially thereinto.

7. A bed of claim 6, wherein said drive member is a gear wherein said second means includes an idler gear rotatably supported on said second part and drivingly engaging said drive member, and includes a reversible drive motor fixedly supported on said second part and having on a drive shaft thereof a pinion which drivingly engages said idler gear, and wherein said second part includes first and second vertically spaced and horizontally extending plates fixedly supported on said second part, said drive member, idler gear and pinion being disposed between said plates and having axial lengths slightly less than the distance between said plates, each said plate having fixedly provided thereon a respective one of said guide portions and having an opening therethrough in alignment with the openings through said guide portion.

8. A bed, comprising: first and second parts, one of said first and second parts being a base portion and the other thereof being a support portion which is disposed above said base portion and can support a person, and selectively actuable spaced first and second lift mechanisms which are each operatively coupled to said first and second parts and which can each effect relative vertical movement between said first and second parts, wherein each of said lift mechanisms includes a first member supported on said second part and held against vertical movement with respect to said second part, said first member having an internally threaded vertical opening therethrough, a second member which is an elongate tube having internal and external threads thereon, said second member extending through said opening in said first member so that said external threads on said second member engage the internal threads of said opening through said first member, a third member which is an elongate member having external threads thereon, said third member having a portion extending into said second member so that the external threads on said third member engage the internal threads on said second member; means for preventing rotation of said third members about lengthwise axes thereof relative to each other and relative to said first part, including one end of each said third member being coupled to said first part, independently controllable first and second reversible drive motors each having a rotatable drive shaft, and first and second drive train means each responsive to rotation of the drive shaft of a respective one of said motors for effecting relative rotation between a respective one of said second members and at least one of said first and third members threadedly engaged therewith.

9. A bed of claim 8, wherein each said first member is a nut fixedly coupled to said second part, wherein each said second member has a longitudinally extending slot in an exterior surface thereof, and wherein each said drive train means includes a drive member which is rotatably supported on said second part, which has thereon a key portion axially slidably disposed in said slot in said second member, and which is rotated in respective first and second directions in response to rotation of the drive shaft of the corresponding drive motor in respective directions.

10. A bed of claim 9, wherein said second part has two pairs of vertically spaced and horizontally extending plates fixedly supported thereon, each said drive member being disposed between said plates of a respective said pair and having an axial length slightly less than the vertical distance between the plates.

11. A bed of claim 10, wherein each said drive member is a drive gear, and wherein each said drive train means includes gear train means disposed between said plates of a respective said pair and drivingly coupling the drive shaft of a respective said drive motor to the associated drive gear.

12. A bed of claim 10, wherein said plates of each said pair have aligned vertical openings therethrough through which a respective said second member extends, and including a plurality of tubular guide portions each supported on a respective said plate coaxial with said opening therethrough and on a side of the plate remote from the other plate of the pair, each said tubular guide portion having an inside diameter slightly greater than an outside diameter of the second member extending therethrough.

13. A bed of claim 8, wherein each said first member is a drive member which is rotatably supported on said second part, and including means for limiting upward and downward movement of each said second member relative to the drive member threadedly engaged therewith and means for limiting upward and downward movement of each said third member relative to the second member threadedly engaged therewith.

14. A bed of claim 13, including two pairs of vertically spaced and horizontally extending plates fixedly supported on said second part, each said drive member being disposed between the plates of a respective said pair and having an axial length slightly less than the distance between the plates.

15. A bed of claim 14, wherein each said drive member is a drive gear, and wherein each said drive train means includes gear train means disposed between said plates of a respective said pair and drivingly coupling the drive shaft of a respective said drive motor to the associated drive gear.

16. A bed of claim 14, wherein said plates of each said pair have aligned vertical openings therethrough through which a respective said second member extends, and including a plurality of tubular guide portions each supported on a respective said plate coaxial with said opening therethrough and on a side of the plate remote from the other plate of the pair, each said tubular guide portion having an inside diameter slightly greater than an outside diameter of the second member extending therethrough.

17. A bed of claim 8, including a plurality of casters provided on said base portion to movably support said base portion on a floor surface.

* * * * *